US011098467B2

(12) United States Patent
Lee

(10) Patent No.: US 11,098,467 B2
(45) Date of Patent: Aug. 24, 2021

(54) AUTOMATIC TOILET PLUNGER DEVICE

(71) Applicant: Michael Lee, University Place, WA (US)

(72) Inventor: Michael Lee, University Place, WA (US)

( * ) Notice: Subject to any disclaimer, the term of this patent is extended or adjusted under 35 U.S.C. 154(b) by 0 days.

(21) Appl. No.: 16/869,046

(22) Filed: May 7, 2020

(65) Prior Publication Data

US 2020/0263402 A1 Aug. 20, 2020

Related U.S. Application Data

(63) Continuation-in-part of application No. 16/184,128, filed on Nov. 8, 2018, now Pat. No. 10,655,312.

(51) Int. Cl.
*E03C 1/308* (2006.01)

(52) U.S. Cl.
CPC ..... *E03C 1/308* (2013.01)

(58) Field of Classification Search
CPC ..... E03C 1/308
USPC ..... 4/255.11, 255.01
See application file for complete search history.

(56) References Cited

U.S. PATENT DOCUMENTS 4,350,178 A * 9/1982 Nelson ..... F16K 31/26 137/441
4,445,236 A 5/1984 Nadolny
6,922,854 B2 8/2005 Allenbaugh
7,877,821 B1 * 2/2011 Prestia ..... E03C 1/304 4/255.04
8,209,790 B1 7/2012 Garry
D810,367 S 2/2018 Hickerson
2012/0247519 A1 10/2012 Dondurur
2014/0223654 A1 * 8/2014 Paulsen ..... E03C 1/306 4/255.04
2014/0298579 A1 10/2014 Nowak
2015/0247309 A1 9/2015 Bugni
2018/0135282 A1 * 5/2018 Radzik ..... E03C 1/308

FOREIGN PATENT DOCUMENTS

WO WO2004009917 1/2004

* cited by examiner

*Primary Examiner* — Lori L Baker

(57) ABSTRACT

An automatic toilet plunger for clearing a blockage in a toilet includes a pipe having a plunger head engaged to a bottom end thereof so that the plunger head is in fluidic communication with the pipe. A pair of arms is hingedly engaged to the pipe. The arms are selectively positionable in an extended configuration and a stowed configuration. In the extended configuration, the arms engage a seat of a toilet. The arms fold downwardly, toward the bottom end of the pipe, into the stowed configuration. A handle, which is engaged to a top end of the pipe and which extends bilaterally therefrom, is hollow and in fluidic communication with the pipe. An actuator is engaged to at least one of the handle and the pipe and positioned therein. The actuator is manipulated to cause the plunger head to clear a blockage in the toilet.

7 Claims, 7 Drawing Sheets

AUTOMATIC TOILET PLUNGER DEVICE

CROSS-REFERENCE TO RELATED APPLICATIONS

This application is a continuation in part of U.S. application Ser. No. 16/184,128 filed on Nov. 8, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to automatic toilet plunger devices and more particularly pertains to a new automatic toilet plunger device for clearing a blockage in a toilet.

(2) Description of Related Art Including Information Disclosed Under 37 CFR 1.97 and 1.98

The prior art relates to automatic toilet plunger devices. Prior art automatic toilet plungers may comprise plungers that utilized drills, pumps, and compressed gases.

BRIEF SUMMARY OF THE INVENTION

An embodiment of the disclosure meets the needs presented above by generally comprising a pipe having a plunger head engaged to a bottom end thereof so that the plunger head is in fluidic communication with the pipe. A pair of arms is hingedly engaged to the pipe. The arms are selectively positionable in an extended configuration and a stowed configuration. In the extended configuration, the arms are configured to engage a seat of a toilet. The arms are configured to fold downwardly, toward the bottom end of the pipe, into the stowed configuration. A handle, which is engaged to a top end of the pipe and which extends bilaterally therefrom, is hollow and in fluidic communication with the pipe. An actuator is engaged to at least one of the handle and the pipe and positioned therein. The actuator is configured, upon manipulation thereof, to cause the plunger head to clear a blockage in the toilet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
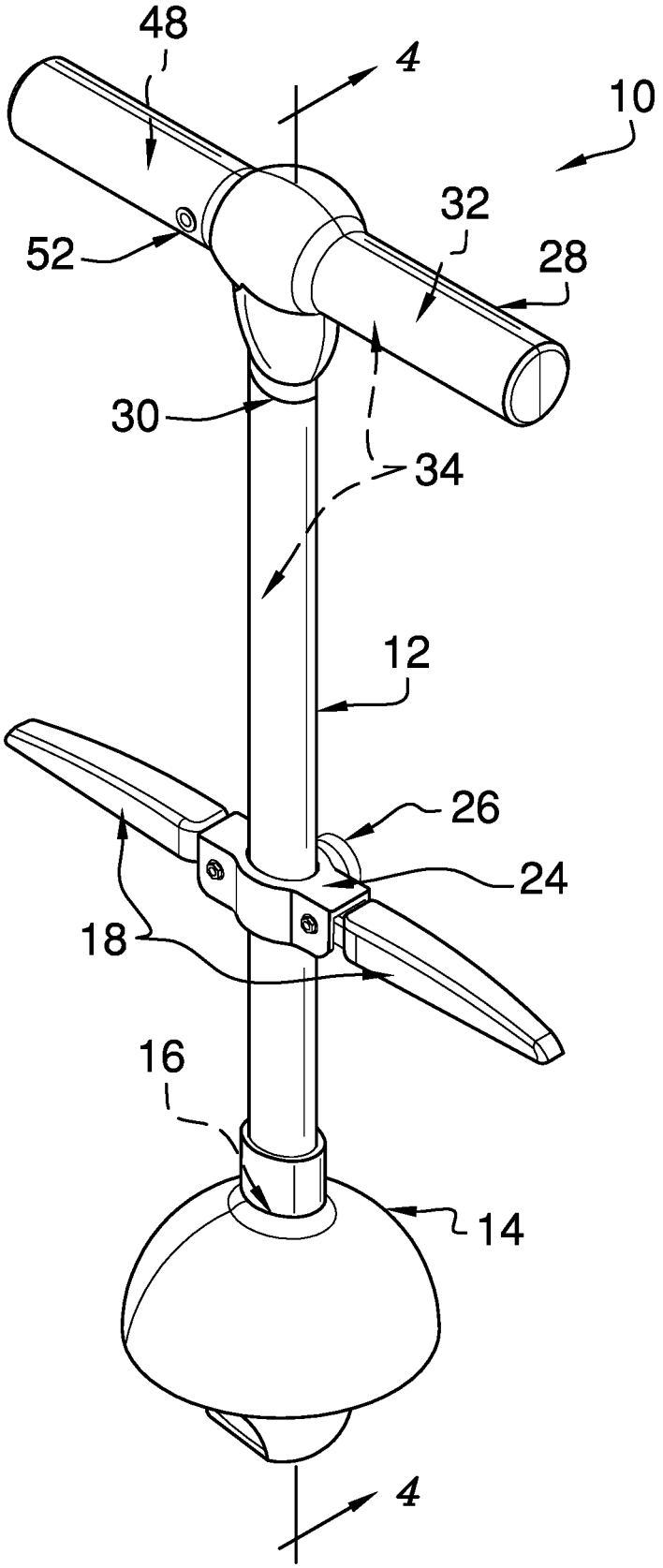
FIG. 1 is an isometric perspective view of an automatic toilet plunger device according to an embodiment of the disclosure.

With reference now to the drawings, and in particular to FIGS. 1 through 7 thereof, a new automatically plunge toilets embodying the principles and concepts of an embodiment of the disclosure and generally designated by the reference numeral 10 will be described.

Figure 2:
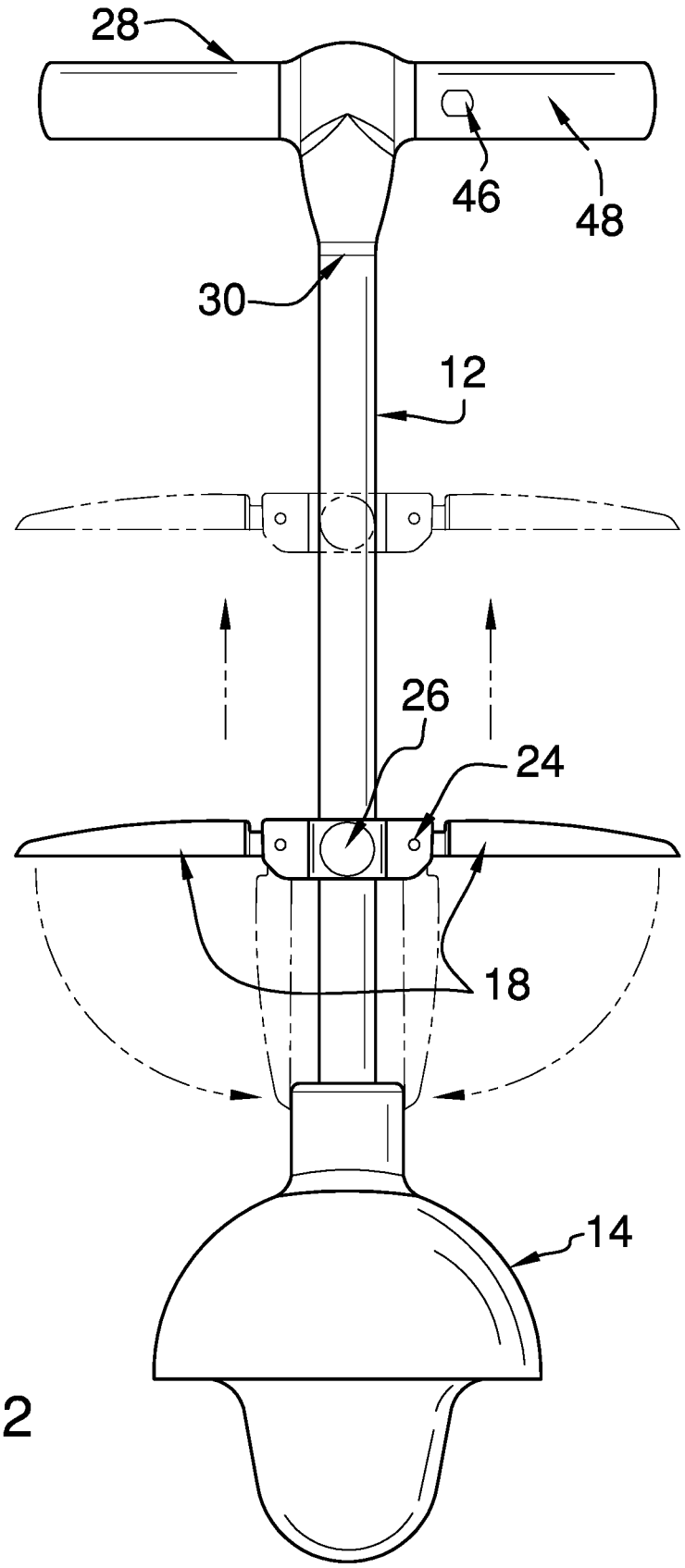
FIG. 2 is a front elevation view of an alternative embodiment of the disclosure.
Figure 3:
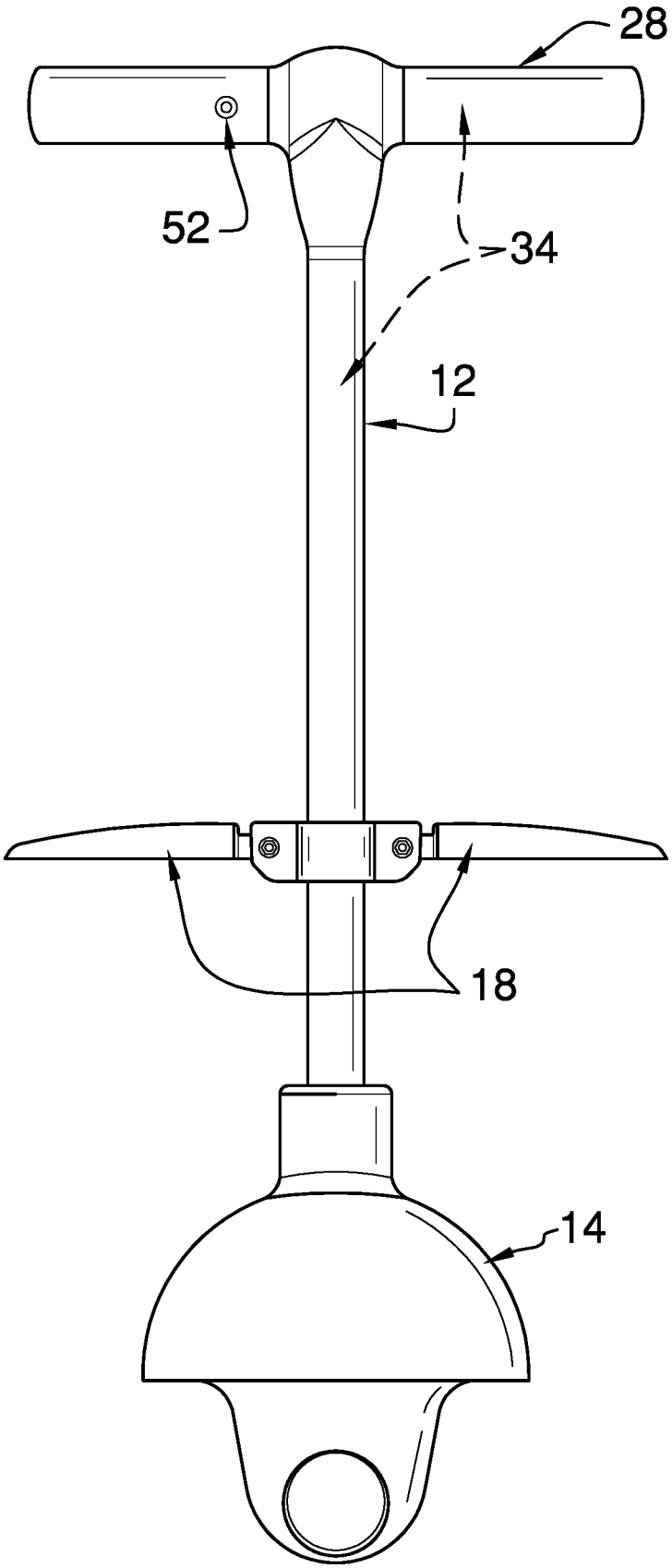
FIG. 3 is a rear elevation view of an alternative embodiment of the disclosure.
Figure 4:
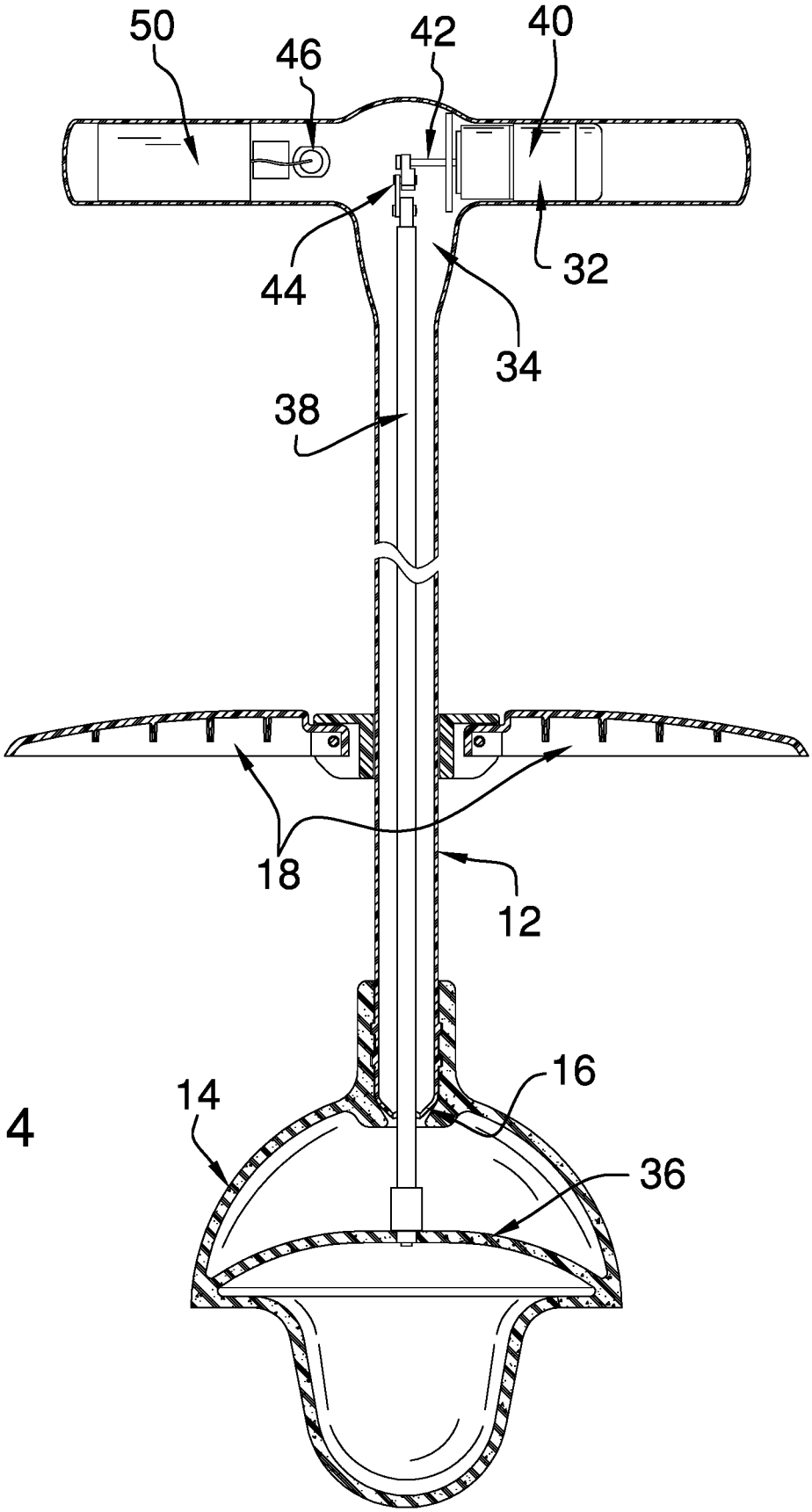
FIG. 4 is a cross-sectional view of an alternative embodiment of the disclosure.
Figure 5:
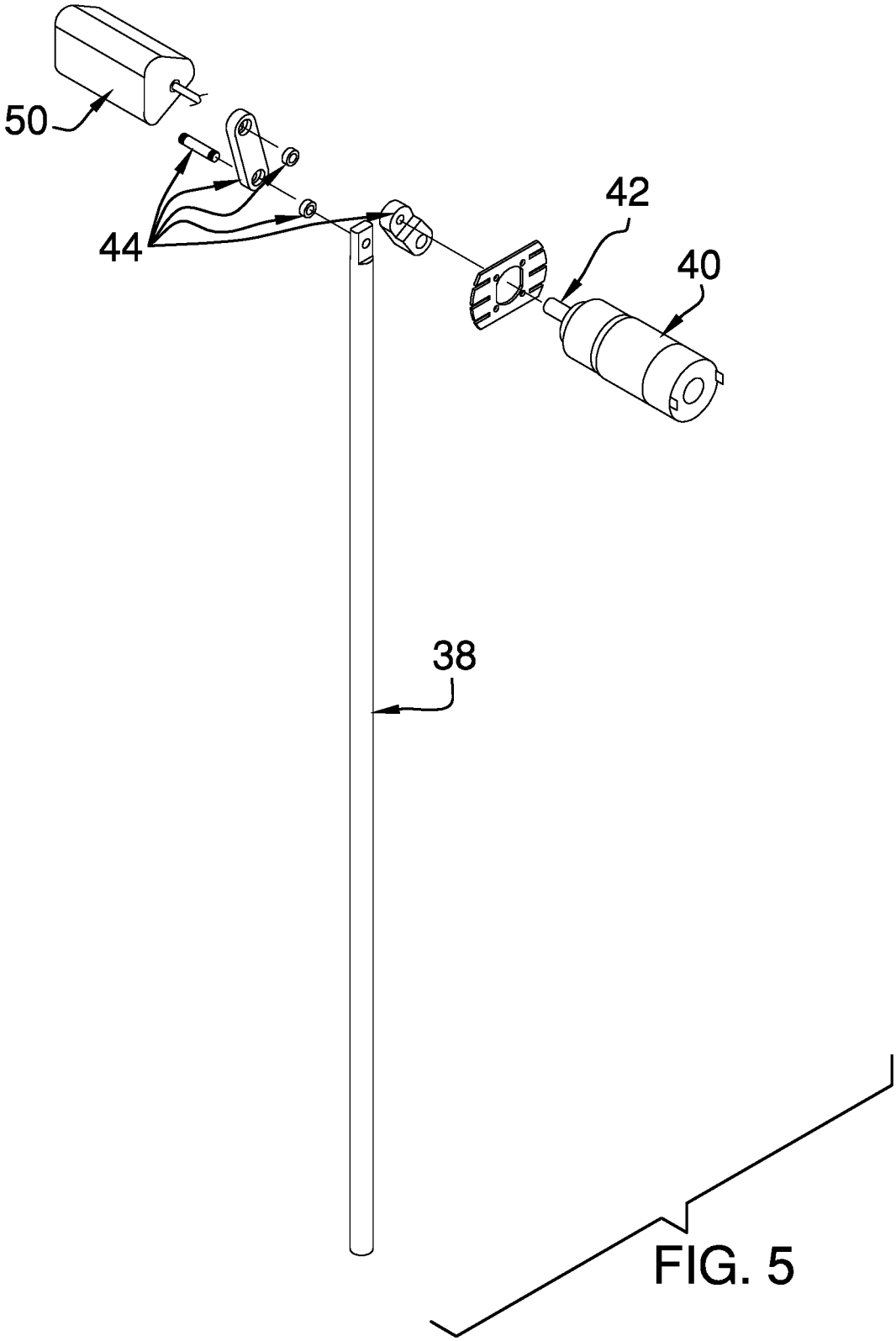
FIG. 5 is an exploded view of an alternative embodiment of the disclosure.
Figure 6:
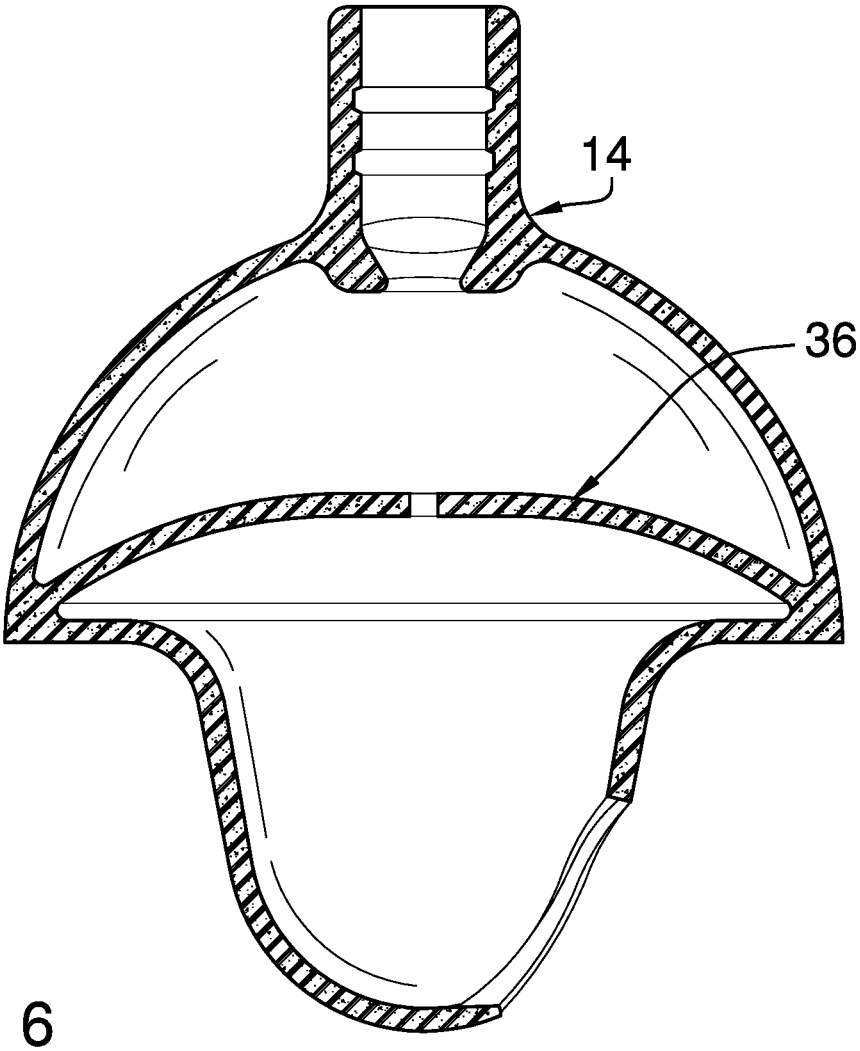
FIG. 6 is a detail view of an alternative embodiment of the disclosure.
Figure 7:
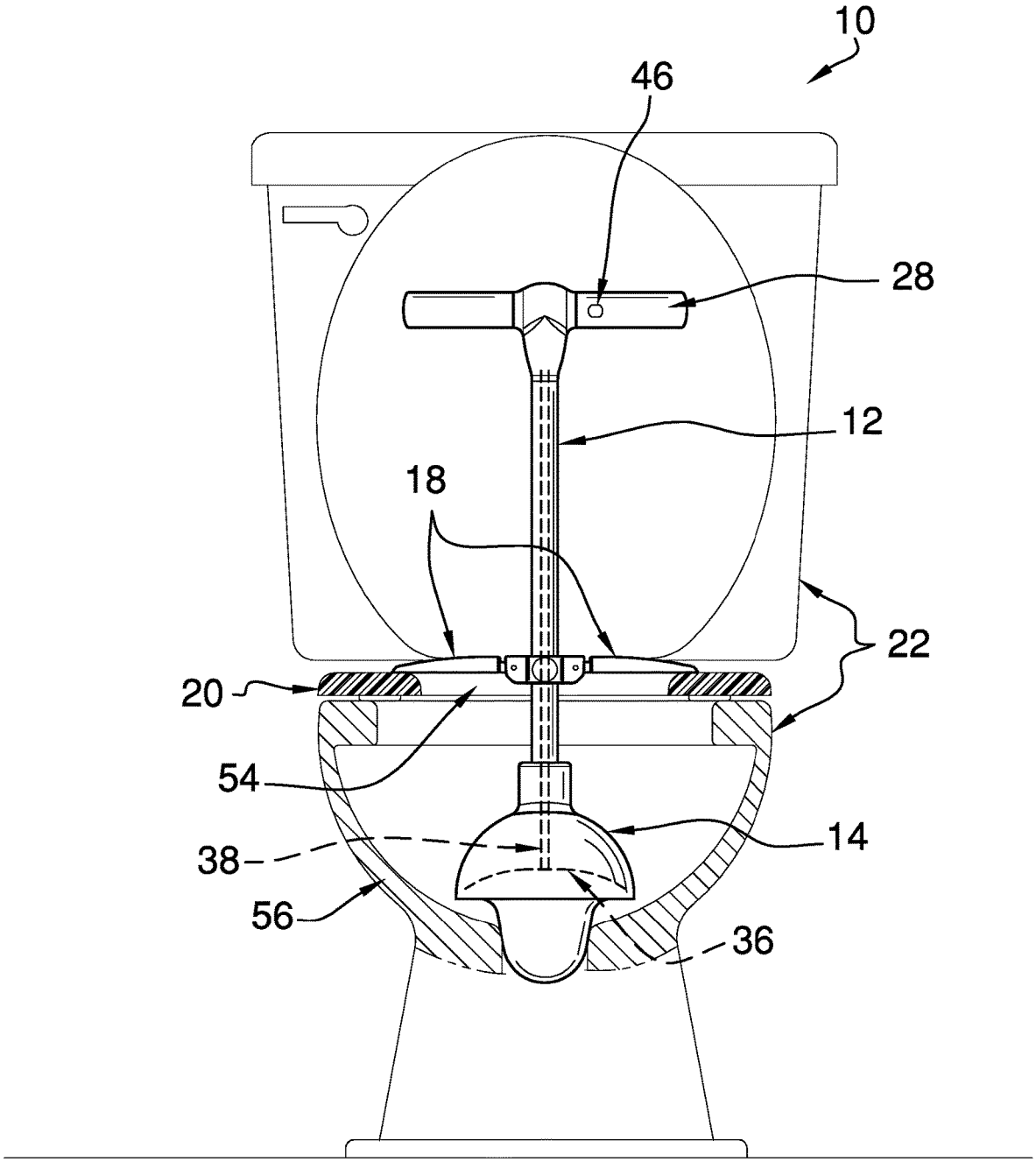
FIG. 7 is an in-use view of an alternative embodiment of the disclosure.

As best illustrated in FIGS. 1 through 7, the automatic toilet plunger device 10 generally comprises a pipe 12 having a plunger head 14 engaged to a bottom end 16 thereof so that the plunger head 14 is in fluidic communication with the pipe 12. A pair of arms 18 is hingedly engaged to the pipe 12. The pair of arms 18 is selectively positionable in an extended configuration, as shown in FIG. 7, wherein the arms 18 are configured to engage a seat 20 of a toilet 22, and a stowed configuration, as shown in FIG. 2. The arms 18 are configured to fold downwardly toward the bottom end 16 of the pipe 12, as shown in FIG. 6.

The device 10 may comprise a mount 24, which is slidably engaged to the pipe 12 and is configured to selectively and fixedly engage the pipe 12. The arms 18 are hingedly engaged to the mount 24. The mount 24 being slidable relative to the pipe 12 enables adjustment of the arms 18 relative to the plunger head 14 so that the arms 18 are positionable upon the seat 20. A thumbscrew 26 is rotationally engaged to and extends through the mount 24. The thumbscrew 26 is configured to be rotated to frictionally engage the pipe 12 so that the mount 24 and the arms 18 are fixedly positioned relative to the pipe 12.

A handle 28 is engaged to a top end 30 of the pipe 12 and extends bilaterally therefrom. The handle 28 is hollow and in fluidic communication with the pipe 12 so that the pipe 12 and the handle 28 define an interior space 34. An actuator 32 is engaged to at least one of the handle 28 and the pipe 12 and is positioned in the interior space 34. The actuator 32 is configured, upon manipulation thereof, to cause the plunger head 14 to clear a blockage in the toilet 22.

A plate 36 is engaged to and positioned within the plunger head 14 such that the plate 36 is orthogonal to the pipe 12. The plate 36 is resiliently deformable. A rod 38 is engaged to and extends from the plate 36, through the pipe 12, to proximate to the handle 28. A motor 40 is engaged to the handle 28 and is positioned in the interior space 34. A shaft 42 of the motor 40 is orthogonal to the rod 38.

A crank unit 44, which is operationally engaged to the shaft 42 and the rod 38, is configured to translate rotational motion of the shaft 42 into a reciprocating motion of the rod 38. The reciprocating motion of the rod 38 alternately deforms the plate 36 upwardly and downwardly relative to the bottom end 16 of the pipe 12. Correspondingly, alternating decreased and elevated pressures are induced upon the blockage in the toilet 22 to loosen and to clear the blockage from the toilet 22.

A controller 46 is engaged to the handle 28 and is operationally engaged to the actuator 32. A power module 48 is positioned in at least one of the pipe 12 and the handle 28. The power module 48 is operationally engaged with the controller 46. The power module 48 is operationally engaged to the actuator 32 and positioned to supply power thereto.

The power module 48 comprises a battery 50, which is positioned in the handle 28. The battery 50 is rechargeable. A port 52 is engaged to the handle 28, proximate to the battery 50. The port 52 is operationally engaged to the battery 50 and is configured for insertion of a plug of a charging cord (not shown) to couple the battery 50 to a source of electrical current to charge the battery 50.

In use, handle 28 is grasped in hands of a user to insert the plunger head 14 through an opening 54 of the seat 20 into a bowl 56 of the toilet 22. The arms 18 engage the seat 20. The controller 46 then is used to activate the motor 40 to cause the plunger head 14 to clear the toilet 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. An automatic toilet plunger device comprising:

a pipe having a plunger head engaged to a bottom end thereof, such that the plunger head is in fluidic communication with the pipe;

a pair of arms hingedly engaged to the pipe such that the arms are selectively positionable in an extended configuration, wherein the arms are configured to engage a seat of a toilet, and a stowed configuration, the arms being configured to fold downwardly toward the bottom end of the pipe;

a handle engaged to a top end of the pipe and extending bilaterally therefrom, the handle being hollow and in fluidic communication with the pipe, such that the pipe and the handle define an interior space;

an actuator engaged to at least one of the handle and the pipe and being positioned in the interior space, the actuator being configured, upon manipulation thereof, to cause the plunger head to clear a blockage in the toilet; and a mount slidably engaged to the pipe and being configured to selectively and fixedly engage the pipe, the arms being hingedly engaged to the mount, such that the mount and the arms are adjustable relative to the plunger head.

2. The automatic toilet plunger device of claim 1, further including a thumbscrew rotationally engaged to and extending through the mount, the thumbscrew being configured to be rotated to frictionally engage the pipe, such that the mount and the arms are fixedly positioned relative to the pipe.

3. The automatic toilet plunger device of claim 1, further including:

the actuator comprising a motor engaged to the handle and positioned in the interior space;

a plate engaged to and positioned within the plunger head, such that the plate is orthogonal to the pipe, the plate being resiliently deformable;

a rod engaged to and extending from the plate through the pipe to proximate to the handle, such that the rod is orthogonal to a shaft of the motor; and a crank unit operationally engaged to the shaft and the rod, the crank unit being configured to translate rotational motion of the shaft into a reciprocating motion of the rod, such that the reciprocating motion of the rod alternately deforms the plate upwardly and downwardly relative to the bottom end of the pipe, alternatingly decreasing and elevating pressures upon the blockage in the toilet to loosen and to clear the blockage from the toilet.

4. The automatic toilet plunger device of claim 1, further including:

a controller engaged to the handle and operationally engaged to the actuator; and a power module positioned in at least one of the pipe and the handle, the power module being operationally engaged with the controller and to the actuator and being positioned to supply power to the latter thereof.

5. The automatic toilet plunger device of claim 4, wherein the power module comprises a battery positioned in the handle.

6. The automatic toilet plunger device of claim 5, further including:

the battery being rechargeable; and a port engaged to the handle proximate to the battery, the port being operationally engaged to the battery and being configured for insertion of a plug of a charging cord, to couple the battery to a source of electrical current, to charge the battery.

7. An automatic toilet plunger device comprising:

a pipe having a plunger head engaged to a bottom end thereof, such that the plunger head is in fluidic communication with the pipe;

a pair of arms hingedly engaged to the pipe such that the arms are selectively positionable in an extended configuration, wherein the arms are configured to engage a seat of a toilet, and a stowed configuration, the arms being configured to fold downwardly toward the bottom end of the pipe;

a mount slidably engaged to the pipe and being configured to selectively and fixedly engage the pipe, the arms being hingedly engaged to the mount, such that the mount and the arms are adjustable relative to the plunger head;

a thumbscrew rotationally engaged to and extending through the mount, the thumbscrew being configured to be rotated to frictionally engage the pipe, such that the mount and the arms are fixedly positioned relative to the pipe;

a handle engaged to a top end of the pipe and extending bilaterally therefrom, the handle being hollow and in fluidic communication with the pipe, such that the pipe and the handle define an interior space;

an actuator engaged to at least one of the handle and the pipe and being positioned in the interior space, the actuator being configured, upon manipulation thereof, to cause the plunger head to clear a blockage in the toilet, the actuator comprising a motor engaged to the handle and positioned in the interior space;

a plate engaged to and positioned within the plunger head, such that the plate is orthogonal to the pipe, the plate being resiliently deformable;

a rod engaged to and extending from the plate through the pipe to proximate to the handle, such that the rod is orthogonal to a shaft of the motor;

a crank unit operationally engaged to the shaft and the rod, the crank unit being configured to translate rotational motion of the shaft into a reciprocating motion of the rod, such that the reciprocating motion of the rod alternately deforms the plate upwardly and downwardly relative to the bottom end of the pipe, alternatingly decreasing and elevating pressures upon the blockage in the toilet to loosen and to clear the blockage from the toilet;

a controller engaged to the handle and operationally engaged to the actuator;

a power module positioned in at least one of the pipe and the handle, the power module being operationally engaged with the controller and to the actuator and being positioned to supply power to the latter thereof, the power module comprising a battery positioned in the handle, the battery being rechargeable; and a port engaged to the handle proximate to the battery, the port being operationally engaged to the battery and being configured for insertion of a plug of a charging cord, to couple the battery to a source of electrical current, to charge the battery.

* * * * *